US011749209B1

(12) United States Patent
Zhou et al.

(10) Patent No.: US 11,749,209 B1
(45) Date of Patent: Sep. 5, 2023

(54) DRIVE CIRCUIT, DISPLAY ASSEMBLY, AND DISPLAY DEVICE

(71) Applicant: HKC CORPORATION LIMITED, Shenzhen (CN)

(72) Inventors: Renjie Zhou, Guangdong (CN); Rongrong Li, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/091,036

(22) Filed: Dec. 29, 2022

(30) Foreign Application Priority Data

Jun. 30, 2022 (CN) ..... 202210759722.X

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2300/0857* (2013.01);
(Continued)

(58) Field of Classification Search
CPC .. G09G 3/3266; G09G 3/3275; G09G 3/3696; G09G 2300/0857; G09G 2300/0866; G09G 2310/0278; G09G 2310/0245; G09G 2310/0248; G09G 2310/0251; G09G 2320/0247;
(Continued)

(56) References Cited

U.S. PATENT DOCUMENTS 8,810,610 B2 * 8/2014 Hong ..... H04N 13/337 348/51
2005/0258772 A1 * 11/2005 Park ..... G09G 3/3225 315/169.1
(Continued)

FOREIGN PATENT DOCUMENTS

CN 101101385 A 1/2008
CN 101211543 A 7/2008
(Continued)

OTHER PUBLICATIONS

First Office Action issued in corresponding CN Application No. CN202210759722.X, dated Aug. 8, 2022, pp. 1-4, Beijing, China.
(Continued)

*Primary Examiner* — Nitin Patel
*Assistant Examiner* — Amen W Bogale
(74) *Attorney, Agent, or Firm* — HAUPTMAN HAM, LLP

(57) ABSTRACT

A drive circuit, a display assembly, and a display device are provided. The drive circuit includes a display drive module, at least one display control module, and a discharge control module. The display control module is configured to receive a data signal and transmit a first power-supply voltage to the display drive module according to the data signal. The display drive module is configured to transmit, under control of a scan signal and the data signal, the first power-supply voltage to a light-emitting element upon reception of the first power-supply voltage, to drive the light-emitting element to emit lights. The discharge control module is configured to receive the first power-supply voltage, and discharge the light-emitting element by adjusting a potential of the scan signal when the first power-supply voltage drops.

20 Claims, 5 Drawing Sheets

(52) U.S. Cl.
CPC ..... *G09G 2310/0278* (2013.01); *G09G 2320/0247* (2013.01); *G09G 2330/02* (2013.01)

(58) Field of Classification Search
CPC ..... G09G 2330/02; G09G 2330/021; G09G 2330/027; G09G 2330/028; G09G 1/005
See application file for complete search history.

(56) References Cited

U.S. PATENT DOCUMENTS

| | | | | |
|---|---|---|---|---|
| 2006/0082527 | A1 | 4/2006 | Ogawa | |
| 2014/0143560 | A1* | 5/2014 | Kwon | G06F 1/30 713/300 |
| 2015/0207014 | A1* | 7/2015 | Inoue | G09G 3/3406 257/440 |
| 2016/0275859 | A1 | 9/2016 | Tseng | |
| 2017/0148375 | A1* | 5/2017 | Kim | G09G 3/20 |
| 2018/0180978 | A1 | 6/2018 | Yamada et al. | |

FOREIGN PATENT DOCUMENTS

| | | | |
|---|---|---|---|
| CN | 101320171 | A | 12/2008 |
| CN | 103943064 | A | 7/2014 |
| CN | 105185293 | A | 12/2015 |
| CN | 107507589 | A | 12/2017 |
| CN | 109872698 | A | 6/2019 |
| CN | 109979375 | A | 7/2019 |
| CN | 110120201 | A | 8/2019 |
| CN | 110246462 | A | 9/2019 |
| CN | 112735346 | A | 4/2021 |
| CN | 213277410 | U | 5/2021 |
| CN | 112967692 | A | 6/2021 |
| CN | 113257206 | A | 8/2021 |
| CN | 213904905 | U | 8/2021 |
| CN | 215770465 | U | 2/2022 |
| CN | 115472125 | A | 12/2022 |
| JP | 2006098941 | A | 4/2006 |

OTHER PUBLICATIONS

WIPO, International Search Report and Written Opinion for International Application No. PCT/CN2022/132825, dated Mar. 8, 2023.

* cited by examiner

DRIVE CIRCUIT, DISPLAY ASSEMBLY, AND DISPLAY DEVICE

CROSS-REFERENCE TO RELATED APPLICATIONS

This application claims priority under 35 U.S.C. § 119(a) to Chinese Patent Application No. 202210759722.X, filed Jun. 30, 2022, the entire disclosure of which is incorporated herein by reference.

TECHNICAL FIELD

This application relates to the field of display technologies, and particularly to a drive circuit, a display assembly having the drive circuit, and a display device having the display assembly.

BACKGROUND

Organic Light-Emitting Diode (OLED) displays have many advantages such as fast response speed, high contrast, low power consumption, easy to match a system integrated circuit to drive, light and thin structure, easy to realize flexible display, etc., and therefore have been widely used in mobile phones, notebooks, and other display devices.

The OLED display generally adopts Thin Film Transistors (TFT), however, a threshold voltage of a TFT decreases when a temperature of the OLED display increases, which may cause screen flickering when powered on after long-term high-temperature operation. Moreover, when the OLED display is powered on and powered off frequently, screen flickering when powered off may occur due to jitter of a power-supply voltage or residual charges in the OLED display.

SUMMARY

In a first aspect, the disclosure provides a drive circuit. The drive circuit includes a display drive module configured to receive a scan signal and a data signal. The drive circuit further includes at least one display control module and a discharge control module. The display control module is electrically coupled with the display drive module. The display control module is configured to receive the data signal, and transmit a first power-supply voltage to the display drive module according to the data signal. The display drive module is configured to transmit, under control of the scan signal and the data signal, the first power-supply voltage to a light-emitting element of the display drive module upon reception of the first power-supply voltage, to drive the light-emitting element to emit lights. The discharge control module is electrically coupled with the display drive module. The discharge control module is configured to receive the first power-supply voltage, and discharge the light-emitting element by adjusting a potential of the scan signal when the first power-supply voltage drops.

In a second aspect, the disclosure further provides a display assembly. The display assembly includes a display panel and the above drive circuit. The drive circuit is electrically coupled with the display panel, and configured to drive the display panel to display different images.

In a third aspect, the disclosure further provides a display device. The display device includes a power-supply module and the above display assembly. The power-supply module is disposed on a non-display surface of the display assembly, and configured to provide a power-supply voltage for the display assembly to display images.

BRIEF DESCRIPTION OF THE DRAWINGS

In order to describe technical solutions of implementations of the disclosure more clearly, the following will give a brief description of accompanying drawings used for describing the implementations. Apparently, accompanying drawings described below are merely some implementations. Those of ordinary skill in the art can also obtain other accompanying drawings based on the accompanying drawings described below without creative efforts.

DETAILED DESCRIPTION

Figure 1:
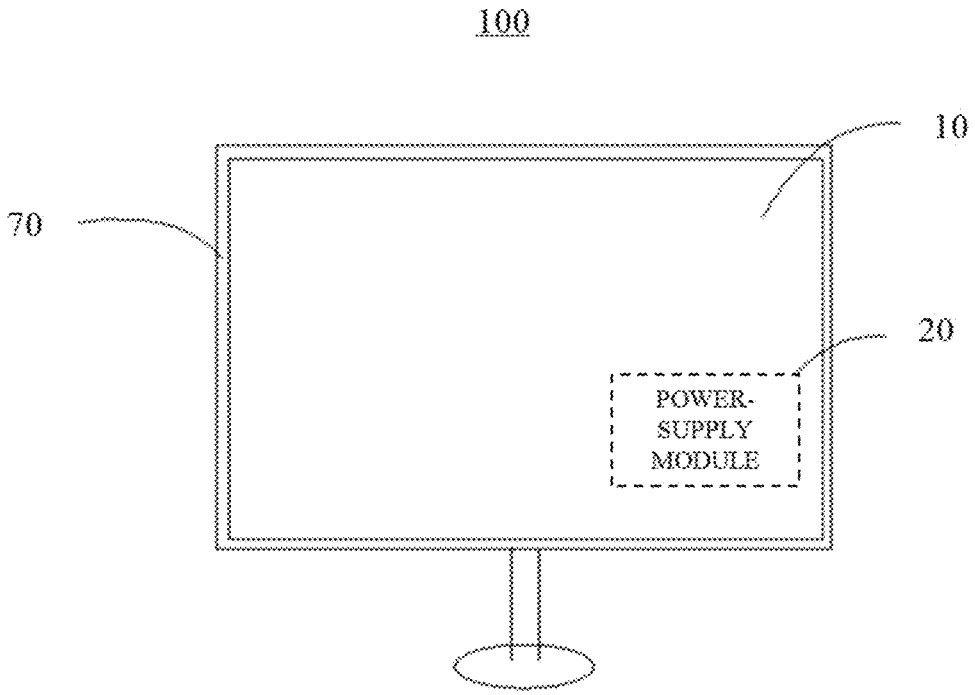
FIG. 1 is a schematic structural diagram illustrating a display device provided in implementations of the disclosure.

In order to facilitate understanding of the disclosure, the disclosure will be described fully below with reference to accompanying drawings. The accompanying drawings illustrate exemplary implementations of the disclosure. However, the disclosure may be implemented in many different forms and is not limited to the implementations described herein. Rather, these implementations are provided to achieve a thorough and complete understanding of disclosed contents of the disclosure.

The description of the following implementations refers to the accompanying drawings to illustrate practical exemplary implementations of the disclosure. In the context, reference signs of components, such as "first" and "second", are merely used to distinguish described objects rather than to describe a particular order or technical meaning. The terms "connection", "coupling", and the like in the disclosure, unless otherwise specified, include direct connection (coupling) and indirect connection (coupling). Directional terms in the disclosure, such as "upper", "lower", "front", "rear", "left", "right", "inner", "outer", "side", refer to directions of the accompanying drawings, and therefore, the directional terms herein are merely for better and clearer description and understanding of the disclosure, rather than indicating or implying that a device or an element referred to must have a specific orientation, and be constructed and operated in a specific orientation, which should not be construed as limiting the disclosure.

It should be noted that, in the description of the disclosure, unless the context clearly indicates otherwise, the terms "mounted", "coupled", "connected", and variations thereof should be broadly understood. For example, the terms may refer to a fixed connection, a removable connection, or an integrated connection; or, may refer to a mechanical connection; or, may refer to a direct connection, an indirect connection via an intermediary, or an internal communication or interaction of two elements. For those skilled in the art, the meanings of the above terms referred to in the disclosure may be understood based on specific situations. It should be noted that, the terms "first", "second", and the like used in the specification, the claims, and the accompany drawings of the disclosure are used to distinguish different objects rather than to describe a particular order. In addition, the terms "include", "comprise", "have", and variations thereof are intended to cover non-exclusive inclusion. For example, a process, method, system, product, or device including a series of steps or units is not limited to the listed steps or units, on the contrary, it can optionally include other steps or units that are not listed; alternatively, other steps or units inherent to the process, method, product, or device can be included either. In addition, the terms "include/comprise", "may include/comprise", "contain", and "may contain" indicate presence of a disclosed function, operation, element, etc., and may indicate, but not limited to, one or more other more functions, operations, elements, etc. Furthermore, the terms "include/comprise" or "contain" indicate presence of a corresponding feature, number, step, operation, element, component, or combinations thereof disclosed in the specification, but do not preclude presence or addition of one or more other features, numbers, steps, operations, elements, components, or combinations thereof, and these terms are intended to cover non-exclusive inclusion. It should also be understood that, the term "at least one" herein means one and more, such as one, two, or three, or the like. The term "a plurality of/multiple" herein means at least two, such as two or three, or the like, unless otherwise specifically defined. The terms "step 1", "step 2", and the like in the specification, the claims, and the accompany drawings of the disclosure are used to distinguish different objects rather than to describe a particular order.

In view of the above deficiencies of the related art, the disclosure provides a drive circuit, a display assembly, and a display device. A display control module and a discharge control module are provided in the drive circuit to adjust transmission timing of a first power-supply voltage, which can effectively ensure accurate transmission of the first power-supply voltage, and avoid screen flickering (that is, screen malfunctioning) caused by abnormal light emission of a display drive module when powered on (that is, started up) and powered off.

The disclosure provides a drive circuit. The drive circuit includes a display drive module configured to receive a scan signal and a data signal. The drive circuit further includes at least one display control module and a discharge control module. The display control module is electrically coupled with the display drive module. The display control module is configured to receive the data signal, and transmit a first power-supply voltage to the display drive module according to the data signal. The display drive module is configured to transmit, under control of the scan signal and the data signal, the first power-supply voltage to a light-emitting element of the display drive module upon reception of the first power-supply voltage, to drive the light-emitting element to emit lights. The discharge control module is electrically coupled with the display drive module. The discharge control module is configured to receive the first power-supply voltage, and discharge the light-emitting element by adjusting a potential of the scan signal when the first power-supply voltage drops.

In some implementations, the display control module includes a first comparator and a first transistor. A non-inverting input end of the first comparator is configured to receive the data signal, an inverting input end of the first comparator is configured to receive a first threshold voltage, an output end of the first comparator is electrically coupled with a control end of the first transistor, and the first comparator is configured to compare a voltage of the data signal with the first threshold voltage, and output a level signal to the control end of the first transistor according to a comparison result. A first end of the first transistor is configured to receive the first power-supply voltage, a second end of the first transistor is electrically coupled with the display drive module, and the first transistor is configured to receive the level signal and is switched on or switched off according to the level signal.

In some implementations, the first comparator is configured to output the level signal of a first potential to the first transistor when the voltage of the data signal is higher than the first threshold voltage, where the first transistor is switched on under control of the level signal of the first potential, to transmit the first power-supply voltage to the display drive module. Alternatively, the first comparator is configured to output the level signal of a second potential to the first transistor when the voltage of the data signal is lower than or equal to the first threshold voltage, where the first transistor is switched off under control of the level signal of the second potential.

In some implementations, the display drive module includes a light-emitting element, a second transistor, a third transistor, and a bypass capacitor. A control end of the second transistor is configured to receive the scan signal, a first end of the second transistor is configured to receive the data signal, a second end of the second transistor is electrically coupled with a control end of the third transistor, and the second transistor is configured to transmit the data signal to the third transistor according to the scan signal. A first end of the third transistor is electrically coupled with the second end of the first transistor to receive the first power-supply voltage, a second end of the third transistor is electrically coupled with the light-emitting element, and the third transistor is switched on or switched off according to the data signal received. A first end of the bypass capacitor is electrically coupled with the control end of the third transistor, and a second end of the bypass capacitor is electrically coupled with a reference ground.

In some implementations, when the second transistor receives the scan signal of a first potential, the second transistor is switched on to transmit the data signal to the control end of the third transistor, and the third transistor is switched on to transmit the first power-supply voltage to the light-emitting element to drive the light-emitting element to emit lights when the third transistor receives the data signal of a first potential, or the third transistor is switched off when the third transistor receives the data signal of a second potential. Alternatively, when the second transistor receives the scan signal of a second potential, the second transistor is switched off.

In some implementations, the light-emitting element has a positive pole electrically coupled with the second end of the third transistor and a negative pole electrically coupled with the reference ground, where the light-emitting element is configured to emit lights once the positive pole of the light-emitting element receives the first power-supply voltage.

In some implementations, the discharge control module includes a flip-flop, a second comparator, a resistor, and a fourth transistor. A clear end of the flip-flop is configured to receive the first power-supply voltage, a preset end of the flip-flop is configured to receive a second power-supply voltage via the resistor, a latch output end of the flip-flop is electrically coupled with a non-inverting input end of the second comparator, and the latch output end of the flip-flop is configured to output a trigger signal of a first potential to the non-inverting input end of the second comparator when the first power-supply voltage drops. The non-inverting input end of the second comparator is configured to receive the trigger signal, an inverting input end of the second comparator is configured to receive a second threshold voltage, and an output end of the second comparator is configured to output a discharge control signal to a control end of the fourth transistor according to a comparison result between a voltage of the trigger signal and the second threshold voltage. The control end of the fourth transistor is electrically coupled with the output end of the second comparator to receive the discharge control signal, a first end of the fourth transistor is configured to transmit the scan signal, a second end of the fourth transistor is configured to receive the scan signal of a first potential, and the fourth transistor is configured to receive, according to the discharge control signal, the scan signal of the first potential to pull up the scan signal at the first end of the fourth transistor.

In some implementations, when the voltage of the trigger signal of the first potential is higher than the second threshold voltage, the output end of the second comparator is configured to output the discharge control signal of a first potential to the control end of the fourth transistor, to control the fourth transistor to be switched on to receive the scan signal of the first potential, to pull up the scan signal at the first end of the fourth transistor to have the first potential. Alternatively, when the voltage of the trigger signal of the first potential is lower than or equal to the second threshold voltage, the output end of the second comparator is configured to output the discharge control signal of a second potential to the control end of the fourth transistor, to control the fourth transistor to be switched off.

The disclosure further provides a display assembly. The display assembly includes a display panel and the above drive circuit. The drive circuit is electrically coupled with the display panel, and configured to drive the display panel to display different images.

The disclosure further provides a display device. The display device includes a power-supply module and the above display assembly. The power-supply module is disposed on a non-display surface of the display assembly, and configured to provide a power-supply voltage for the display assembly to display images.

According to the drive circuit, the display assembly, and the display device of the disclosure, the display control module and the discharge control module are provided in the drive circuit to selectively control transmission of the first power-supply voltage in the display drive module, that is, timing adjustment of the first power-supply voltage is achieved, which can effectively ensure accurate transmission of the first power-supply voltage, and avoid screen flickering caused by abnormal light emission of the display drive module when powered on and powered off, thereby improving a display effect of the display assembly.

In addition, by arranging the discharge control module in the drive circuit, a potential of the first power-supply voltage in the drive circuit can be detected in real time. When the first power-supply voltage drops, that is, when the display device is to be powered off or restarted, the display device is discharged by the discharge control module through the scan signal, so that all light-emitting elements are discharged from the first potential when the display device is to be powered off. As such, the light-emitting elements are all on, and residual charges of the whole display panel can be released faster, which can avoid screen flickering of the display panel caused by the display drive module being powered on by mistake due to jitter of the first power-supply voltage or residual charges of the whole display assembly in the drive circuit. Therefore, a display effect of the display assembly and the display device can be improved effectively, and a user experience can also be improved.

In the field of display technologies, a display device generally includes a display panel and a backlight component, where the display panel is mounted on a light-emitting side of the backlight component, and the backlight component is configured to provide backlight for the display panel to adjust the display panel to display different images.

Referring to FIG. 1, FIG. 1 is a schematic structural diagram illustrating a display device 100 provided in implementations of the disclosure. As illustrated in FIG. 1, the display device 100 of implementations of the disclosure may at least include a display assembly 10, a power-supply module 20, and a support frame 70. The display assembly 10 is fixed to the support frame 70. The power-supply module 20 is disposed on the back of the display assembly 10, that is, a non-display surface of the display assembly 10, that is, one side of the display assembly 10 facing away from a user. The display assembly 10 is configured to display an image. The power-supply module 20 is electrically coupled with the display assembly 10, and configured to provide a power-supply voltage for the display assembly 10 to display an image. The support frame 70 supports and protects the display assembly 10 and the power-supply module 20.

It can be understood that, the display assembly 10 further has a display surface opposite to the non-display surface, that is, a front surface of the display assembly 10, that is, one side of the display assembly 10 facing the user. The display surface facing the user who uses the display device 100 is configured to display an image.

Figure 2A:
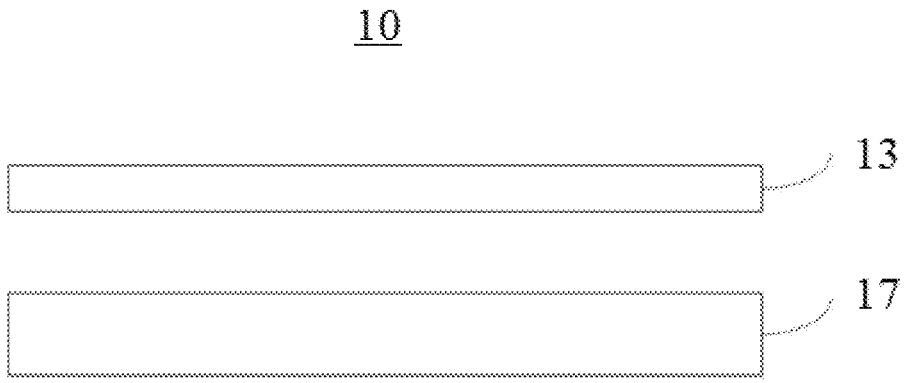
FIG. 2A is a schematic structural diagram illustrating a display assembly of the display device illustrated in FIG. 1.
Figure 2B:
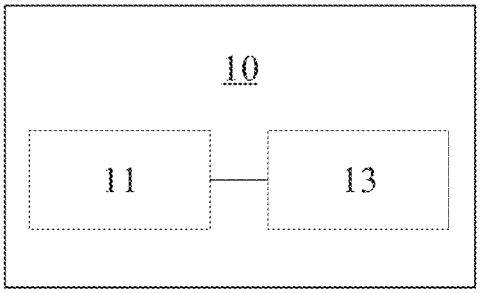
FIG. 2B is a block diagram illustrating a display assembly provided in implementations of the disclosure.

Referring to FIG. 2A and FIG. 2B together, FIG. 2A is a schematic structural diagram illustrating a display assembly 10 of the display device 100 illustrated in FIG. 1, and FIG. 2B is a block diagram illustrating the display assembly 10 provided in implementations of the disclosure. The display assembly 10 of implementations of the disclosure may at least include a display panel 13 and a Backlight Module (BM) 17. The display panel 13 is disposed on a light-emitting side of the BM 17. The BM 17 is configured to provide the display panel 13 with lights for display. The display panel 13 is configured to display an image by emitting lights according to image data to-be-displayed. The display panel of implementations of the disclosure may be a display panel that adopts a Passive Matrix (PM) drive mode, such as a Micro Light-Emitting Diode (Micro-LED) display panel, an Organic Light-Emitting Diode (OLED) display panel, a Mini Light-Emitting Diode (Mini-LED) display panel, or the like.

In exemplary implementations of the disclosure, the display assembly 10 further includes other elements or components, for example, a signal processor, a signal sensing module, etc.

Figure 3:
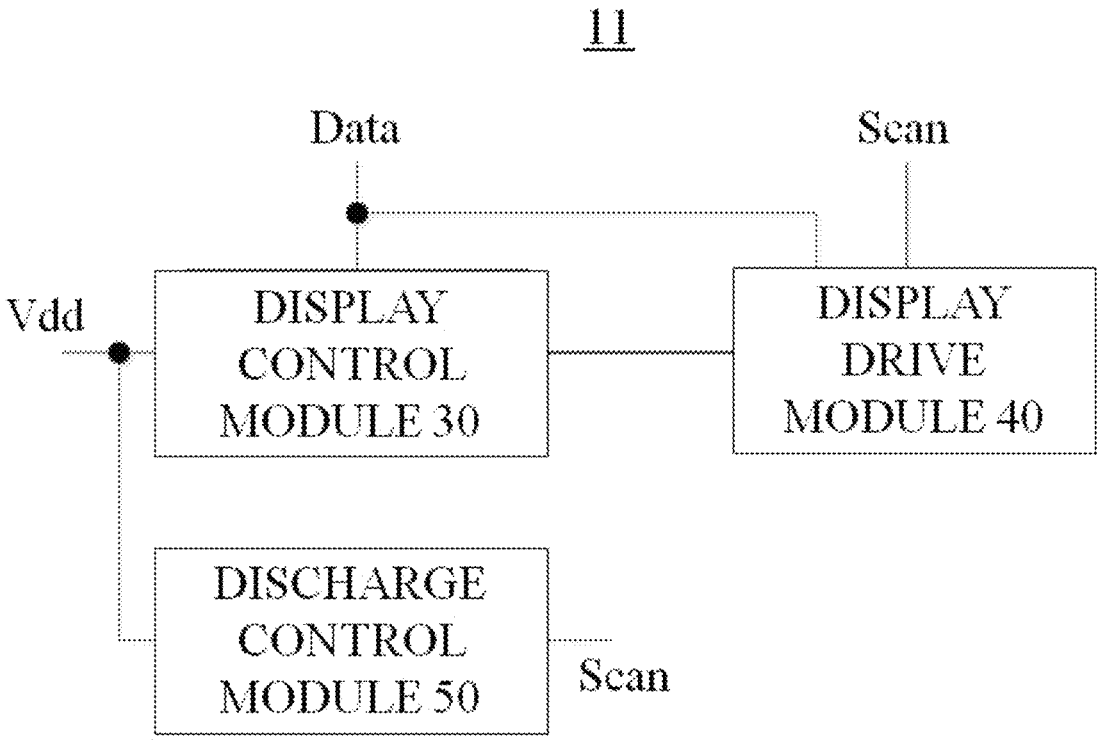
FIG. 3 is a schematic functional structural diagram illustrating a drive circuit provided in implementations of the disclosure.

Referring to FIG. 3 together, FIG. 3 is a schematic functional structural diagram illustrating a drive circuit 11 provided in implementations of the disclosure. Further, the display assembly 10 of implementation of the disclosure at least includes a drive circuit 11. The drive circuit 11 may be disposed in a peripheral area (e.g., a non-display area surrounding a display area) of the display panel 13. The drive circuit 11 is electrically coupled with the display panel 13, and configured to provide a drive signal for the display panel 13. The drive circuit 11 is electrically coupled with the BM 17, and cooperates with the BM 17 to make the display panel 13 display an image.

The drive circuit 11 of implementations of the disclosure can be applied to the display panel 13. The drive circuit 11 at least includes at least one display control module 30, a display drive module 40, and a discharge control module 50. The display control module 30 is electrically coupled with the display drive module 40. The display control module 30 is configured to receive a data signal Data, and selectively transmit a first power-supply voltage Vdd to the display drive module 40 according to the data signal Data. The display drive module 40 is configured to receive a scan signal Scan and the data signal Data. When the display drive module 40 receives the first power-supply voltage Vdd, a light-emitting element 41 is driven by the first power-supply voltage Vdd to emit lights under control of the scan signal Scan and the data signal Data. The discharge control module 50 is electrically coupled with the display drive module 40. The discharge control module 50 is configured to receive the first power-supply voltage Vdd, receive the scan signal Scan from the display drive module 40, and discharge the display panel 13 by adjusting a potential of the scan signal Scan when the first power-supply voltage Vdd drops (e.g., when the display assembly 10 is to be powered off).

In implementations of the disclosure, by arranging the display control module 30 and the discharge control module 50 in the drive circuit 11, transmission of the first power-supply voltage Vdd in the display drive module 40 can be controlled, that is, timing adjustment of the first power-supply voltage is achieved, which can effectively ensure accurate transmission of the first power-supply voltage Vdd, and avoid screen flickering caused by abnormal light emission of the display drive module 40 when powered on and powered off.

In implementations of the disclosure, the display drive module 40 may be a 2T1C pixel circuit. In other implementations, the display drive module 40 may also be a 3T1C pixel circuit, a 4T1C pixel circuit, a 7T2C pixel circuit, etc., which is not limited in the disclosure.

Figure 4:
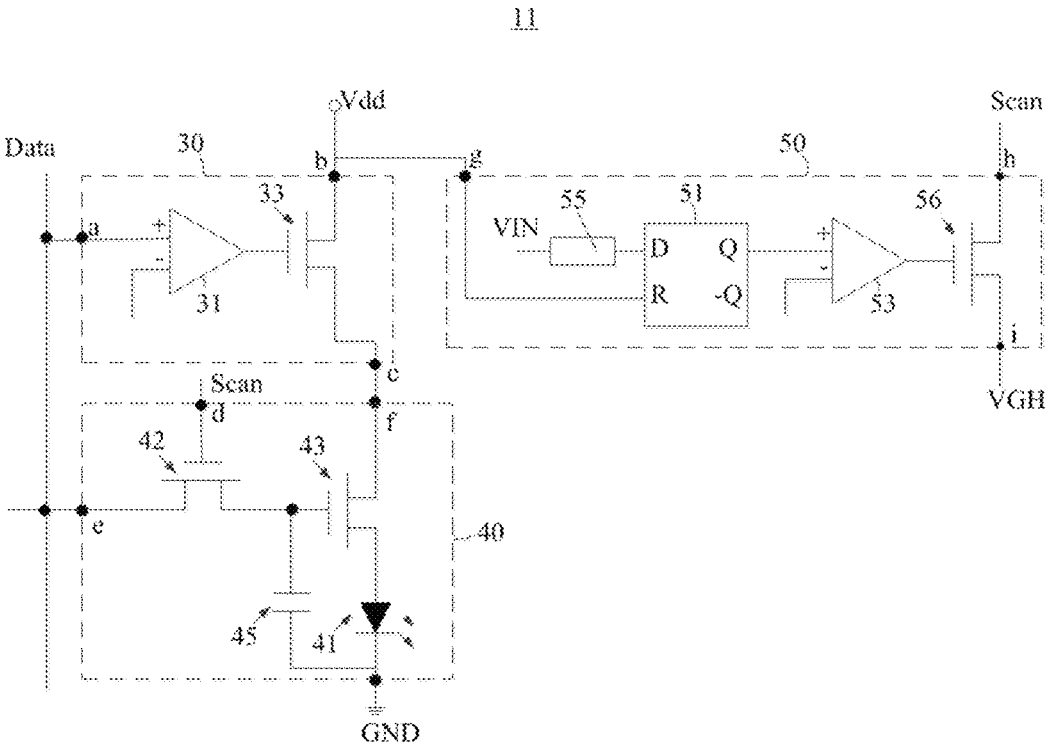
FIG. 4 is a circuit structural diagram of the drive circuit illustrated in FIG. 3.

Referring to FIG. 4 together, FIG. 4 is a circuit structural diagram of the drive circuit 11 illustrated in FIG. 3. The display control module 30 of implementations of the disclosure is configured to adjust a power-on timing of the first power-supply voltage Vdd. The display control module 30 includes a first data-signal end a, a power input end b, and a signal output end c. The display control module 30 is configured to receive the data signal Data from the first data-signal end a, and receive the first power-supply voltage Vdd from the power input end b. The display control module 30 is configured to control, according to the data signal Data, outputting of the first power-supply voltage Vdd to the display drive module 40 from the signal output end c.

In specific implementations of the disclosure, the display control module 30 further includes a first comparator 31, a first transistor 33, and a first threshold unit (not illustrated). The first comparator 31 includes a non-inverting input end, an inverting input end, and an output end. The data signal Data is inputted to the first comparator 31 via the non-inverting input end. The first threshold unit is configured to output a first threshold voltage Vf1, where the first threshold voltage Vf1 is inputted to the first comparator 31 via the inverting input end. The first comparator 31 is configured to compare a voltage of the data signal Data with the first threshold voltage Vf1, and output a level signal at its output end according to a comparison result, where the level signal indicates whether the data signal Data corresponds to a working value.

Specifically, if the voltage of the data signal Data is higher than the first threshold voltage Vf1, the output end of the first comparator 31 is configured to output the level signal of a first potential, where the level signal of a first potential indicates that the data signal Data corresponds to a working value. Conversely, if the voltage of the data signal Data is lower than or equal to the first threshold voltage Vf1, the output end of the first comparator 31 is configured to output the level signal of a second potential, where the level signal of a second potential indicates that the data signal Data corresponds to a non-working value.

It can be understood that, a set value of the first threshold voltage Vf1 is smaller than the working value of the data signal Data, so that the data signal Data can be correctly transmitted in the display drive module 40.

In implementations of the disclosure, the first comparator 31 may be a voltage comparator. The first potential may be a high potential, and accordingly, the level signal of the first potential may be a level signal of a high potential. The second potential may be a low potential, and accordingly, the level signal of the second potential may be a level signal of a low potential, which is not limited in the disclosure.

In specific implementations of the disclosure, the first transistor 33 is configured to selectively transmit the first power-supply voltage Vdd to the display drive module 40 according to the level signal. The first transistor 33 includes a control end, a first end, and a second end. The control end of the first transistor 33 is electrically coupled with the output end of the first comparator 31 to receive the level signal, where the first transistor 33 is in an on-state or an off-state under control of the level signal. The first end of the first transistor 33 is electrically coupled with the power input end b, to receive the first power-supply voltage Vdd from the power input end b. The second end of the first transistor 33 is electrically coupled with the signal output end c. The first end and the second end of the first transistor 33 are electrically connected or disconnected according to the level signal.

Specifically, if the control end of the first transistor 33 receives the level signal of a first potential from the output end of the first comparator 31, the first end and the second end of the first transistor 33 are electrically connected, that is, the first transistor 33 is in an on-state. In this situation, the first power-supply voltage Vdd is transmitted to the display drive module 40 from the signal output end c, to drive the light-emitting element 41 to emit lights. If the control end of the first transistor 33 receives the level signal of a second potential from the output end of the first comparator 31, the first end and the second end of the first transistor 33 are electrically disconnected, that is, the first transistor 33 is in an off-state. In this situation, the first power-supply voltage Vdd cannot be transmitted to the signal output end c, and accordingly, the first power-supply voltage Vdd cannot be transmitted to the display drive module 40.

In specific implementations of the disclosure, the first transistor 33 may be a Metal-Oxide-Semiconductor Field-Effect Transistor (MOSFET), which is not limited in the disclosure.

In implementations of the disclosure, by arranging the display control module 30, whether the data signal Data corresponds to a working value can be determined according to the potential of the level signal outputted by the output end of the first comparator 31, so that the power-supply voltage Vdd is selectively supplied to the display drive module 40. As such, the display drive module 40 is controlled to emit lights only when the display drive module 40 receives the first power-supply voltage Vdd, which can avoid abnormal light emission of the display drive module 40 caused by a wrong power-on timing of the first power-supply voltage Vdd, thereby improving a display effect of the display panel.

In implementations of the disclosure, as illustrated in FIG. 4, the display drive module 40 includes a first scan-signal end d, a second data-signal end e, and a first power receiving end f. The display drive module 40 is configured to receive the scan signal Scan from the first scan-signal end d, and the display drive module 40 is configured to receive the data signal Data from the second data-signal end e. The first power receiving end f is electrically coupled with the signal output end c to receive the first power-supply voltage Vdd, that is, the display drive module 40 is electrically coupled with the second end of the first transistor 33 of the display control module 30 through the first power receiving end f and the signal output end c.

In specific implementations of the disclosure, the display drive module 40 includes the light-emitting element 41, a second transistor 42, and a third transistor 43. The second transistor 42 and the third transistor 43 each include a control end, a first end, and a second end. The control end of the second transistor 42 is electrically coupled with the first scan-signal end d to receive the scan signal Scan. The second transistor 42 is in an on-state or an off-state under control of the scan signal Scan, that is, the first end and the second end of the second transistor 42 are controlled to be electrically connected or disconnected. The first end of the second transistor 42 is electrically coupled with the second data-signal end e to receive the data signal Data. The second end of the second transistor 42 is electrically coupled with the control end of the third transistor 43. The second transistor 42 is configured to selectively transmit the data signal Data to the control end of the third transistor 43 according to the scan signal Scan.

The first end of the third transistor 43 is electrically coupled with the first power receiving end f to receive the first power-supply voltage Vdd from the first power receiving end f, that is, the first end of the third transistor 43 is electrically coupled with the second end of the first transistor 33 to receive the first power-supply voltage Vdd. The second end of the third transistor 43 is electrically coupled with the light-emitting element 41. The control end of the third transistor 43 is configured to receive the data signal Data transmitted by the second transistor 42. The second end and the first end of the third transistor 43 are electrically connected or disconnected according to the data signal Data, to selectively transmit the first power-supply voltage Vdd to the light-emitting element 41 from the first power receiving end f.

Specifically, when the control end of the second transistor 42 receives the scan signal Scan of a first potential, the second transistor 42 is in an on-state, to transmit the data signal Data to the control end of the third transistor 43. If the control end of the third transistor 43 receives the data signal Data of a first potential, the first end and the second end of the third transistor 43 are electrically connected, that is, the third transistor 43 is in an on-state, to transmit the first power-supply voltage Vdd to the light-emitting element 41 from the first power receiving end f. Conversely, if the control end of the third transistor 43 receives the data signal Data of a second potential, the first end and the second end of the third transistor 43 are electrically disconnected, that is, the third transistor 43 is in an off-state, and thus, the first power-supply voltage Vdd cannot be transmitted to the light-emitting element 41.

When the control end of the second transistor 42 receives the scan signal Scan of a second potential, the second transistor 42 is in an off-state, and thus, the data signal Data cannot be transmitted to the control end of the third transistor 43.

In other words, in these implementations, when the scan signal Scan has a first potential and the data signal Data has a first potential, the first power-supply voltage Vdd is transmitted to the light-emitting element 41 from the first power receiving end f, to drive the light-emitting element 41 to emit lights.

In specific implementations of the disclosure, the light-emitting element 41 has a positive pole (also called "anode") and a negative pole (also called "cathode"). The positive pole of the light-emitting element 41 is electrically coupled with the second end of the third transistor 43, and the negative pole of the light-emitting element 41 is electrically coupled with a reference ground GND. Specifically, when the light-emitting element 41 receives the first power-supply voltage Vdd from the second end of the third transistor 43, the light-emitting element 41 emits lights. When no first power-supply voltage Vdd is received by the light-emitting element 41 from the second end of the third transistor 43, the light-emitting element 41 does not emit lights.

In implementations of the disclosure, the display drive module 40 further includes a bypass capacitor 45. A first end of the bypass capacitor 45 is electrically coupled with the control end of the third transistor 43, and a second end of the bypass capacitor 45 is electrically coupled with the reference ground GND to protect the light-emitting element 41 from being damaged.

In specific implementations of the disclosure, the second transistor 42, the third transistor 43, and the bypass capacitor 45 of the display drive module 40 each may be disposed in the display panel 13.

In specific implementations of the disclosure, the second transistor 42 and the third transistor 43 each may be a Thin Film Transistor (TFT), which is not limited in the disclosure.

In implementations of the disclosure, as illustrated in FIG. 4, the discharge control module 50 includes a second power receiving end g, a second scan-signal end h, and a discharge end i. When the display device 100 is to be powered off or restarted, the discharge control module 50 is configured to transmit the residual first power-supply voltage Vdd to the reference ground GND for release, that is, the display device 100 is discharged through the scan signal Scan. Specifically, the discharge control module 50 is configured to receive the first power-supply voltage Vdd through the second power receiving end g, and the discharge control module 50 is configured to selectively pull up the scan signal Scan to the first potential (e.g., a high level VGH of the scan signal Scan illustrated in FIG. 6) according to the first power-supply voltage Vdd, so that the first power-supply voltage Vdd in the display drive module 40 is transmitted to the reference ground GND for release, that is, the display device 100 is discharged through the scan signal Scan. In this way, when the display device 100 is to be powered off, all TFTs are discharged from the first potential (e.g., a high level VGH of the scan signal Scan). As such, the TFTs are all on, and thus, residual charges of the whole display panel can be released faster.

It can be understood that, when the display device 100 executes a power-off or restart command, the first power-supply voltage Vdd drops. In these implementations, the discharge control module 50 is configured to determine whether the display device 100 (e.g., the display assembly 10) is to be powered off or restarted according to a potential change of the first power-supply voltage Vdd.

In specific implementations of the disclosure, as illustrated in FIG. 4, the discharge control module 50 further includes a flip-flop 51, a second comparator 53, a resistor 55, a fourth transistor 56, and a second threshold unit (not illustrated). The flip-flop 51 includes a preset end D, a clear end R, and a latch output end Q. The first power-supply voltage Vdd is inputted to the flip-flop 51 via the clear end R, that is, the clear end R is electrically coupled with the second power receiving end g to receive the first power-supply voltage Vdd. A first end of the resistor 55 is electrically coupled with the preset end D, and a second end of the resistor 55 is configured to receive a second power-supply voltage VIN, that is, the second power-supply voltage VIN is transmitted to the preset end D via the resistor 55. The latch output end Q is electrically coupled with the second comparator 53. The flip-flop 51 is configured to output a trigger signal of a first potential at the latch output end Q upon detecting that the received first power-supply voltage Vdd drops. In implementations of the disclosure, the second power-supply voltage VIN is a total input voltage of the whole light-emitting element 41.

In specific implementations of the disclosure, the flip-flop 51 may be a falling edge triggered D flip-flop, and the resistor 55 may be a trigger resistor, which are not limited in the disclosure.

In specific implementations of the disclosure, the second comparator 53 includes a non-inverting input end, an inverting input end, and an output end. The non-inverting input end of the second comparator 53 is electrically coupled with the latch output end Q of the flip-flop 51 to receive the trigger signal of a first potential. The inverting input end of the second comparator 53 is configured to receive a second threshold voltage Vf2 provided by the second threshold unit. The output end of the second comparator 53 is electrically coupled with the fourth transistor 56. The second comparator 53 is configured to compare the trigger signal of a first potential with the second threshold voltage Vf2, and output a discharge control signal from the output end of the second comparator 53 to the fourth transistor 56 according to a comparison result. The discharge control signal indicates whether residual charges of the display assembly 10 need to be released at this time.

Specifically, if a voltage of the trigger signal of the first potential is higher than the second threshold voltage Vf2, the output end of the second comparator 53 is configured to output the discharge control signal of a first potential, where the discharge control signal of a first potential indicates that the first power-supply voltage Vdd needs to be released. Conversely, if the voltage of the trigger signal of the first potential is lower than or equal to the second threshold voltage Vf2, the output end of the second comparator 53 is configured to output the discharge control signal of a second potential, where the discharge control signal of a second potential indicates that the first power-supply voltage Vdd does not need to be released. In implementations of the disclosure, the trigger signal may be a high-level signal.

In implementations of the disclosure, the second comparator 53 may be a voltage comparator.

In specific implementations of the disclosure, the fourth transistor 56 includes a control end, a first end, and a second end. The control end of the fourth transistor 56 is electrically coupled with the output end of the second comparator 53 to receive the discharge control signal from the output end of the second comparator 53, where the fourth transistor 56 is in an on-state or an off-state under control of the discharge control signal. The first end of the fourth transistor 56 is electrically coupled with the second scan-signal end h, to transmit the scan signal Scan through the second scan-signal end h. The second end of the fourth transistor 56 is electrically coupled with the discharge end i to receive the scan signal Scan of a first potential (e.g., a scan signal Scan of a high level VGH) from the discharge end i. The fourth transistor 56 is configured to selectively pull up the scan signal Scan under control of the discharge control signal, for example, make the scan signal Scan have a high level VGH.

Specifically, when the control end of the fourth transistor 56 receives the discharge control signal of a first potential, the first end and the second end of the fourth transistor 56 are electrically connected, that is, the fourth transistor 56 is in an on-state, and the second end of the fourth transistor 56 receives the scan signal Scan of a first potential (e.g., a scan signal of a high level VGH) from the discharge end i, so that the scan signal Scan at the second scan-signal end h can be pulled up to have the first potential. As such, when the first power-supply voltage Vdd drops (e.g., when the display assembly 10 is to be powered off or restarted), the display panel 13 can be discharged by pulling up the scan signal Scan at the first end of the fourth transistor 56.

It should be noted that, the first potential may be a high potential or a low potential, which is not limited in the disclosure. In addition, the term "pulling up" refers to pulling up a low potential to a high potential. For ease of understanding, the above implementations are depicted by taking the first potential as a high potential as an example, that is, the scan signal of the first potential is a scan signal of a high potential.

When the control end of the fourth transistor 56 receives the discharge control signal of a second potential, the first end and the second end of the fourth transistor 56 are electrically disconnected, that is, the fourth transistor 56 is in an off-state, and the second end of the fourth transistor 56 cannot receive the scan signal Scan of a first potential from the discharge end i, so that the scan signal Scan at the second scan-signal end h cannot be pulled up to have the first potential.

In implementations of the disclosure, the second power-supply voltage VIN may be a total input voltage of the display device 100, which is not limited in the disclosure.

In implementations of the disclosure, the phrase "the first power-supply voltage Vdd needs to be released" may specifically refer to residual charges in the whole display assembly 10 when the display device 100 is to be powered off or restarted, or charges generated due to jitter of the first power-supply voltage Vdd, which is not limited in the disclosure.

In implementations of the disclosure, by arranging the discharge control module 50, a potential change of the first power-supply voltage Vdd in the drive circuit 11 (e.g., when the display assembly 10 executes a power-off or restart command, the first power-supply voltage Vdd drops) can be detected in real time. When the first power-supply voltage Vdd drops, that is, when the display device 100 is to be powered off or restarted, the discharge control module 50 is configured to receive the scan signal Scan of a first potential (e.g., a scan signal of a high level VGH) from the discharge end i, so that the scan signal Scan at the second scan-signal end h can be pulled up to have the first potential (i.e., a high level VGH), that is, the display device 100 can be discharged through the scan signal Scan. In this way, when the display device 100 is to be powered off, all TFTs are discharged from the first potential (e.g., a high level VGH of the scan signal Scan). As such, the TFTs are all on, and thus, residual charges of the whole display panel 13 can be released faster, which can avoid screen flickering of the display panel 13 caused by the light-emitting element 41 being powered on by mistake due to remaining of the first power-supply voltage Vdd in the display assembly 10.

Figure 5:
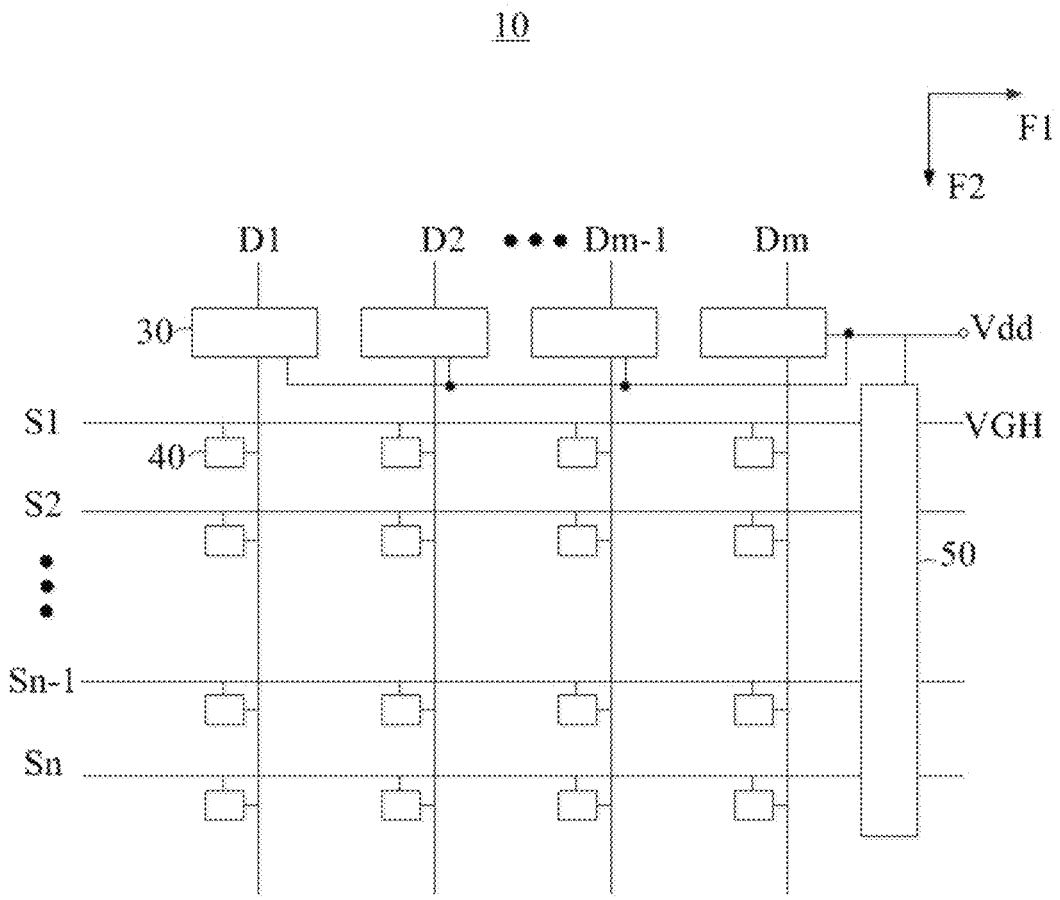
FIG. 5 is a partial circuit diagram of a display assembly provided in implementations of the disclosure.

Referring to FIG. 5, FIG. 5 is a partial circuit diagram of a display assembly 10 provided in implementations of the disclosure. In implementations of the disclosure, as illustrated in FIG. 5, multiple scan lines S1-Sn extending along a first direction F1 and multiple data lines D1-Dm extending along a second direction F2 are arranged in the display panel 13 and cooperatively form a grid. The first direction F1 is perpendicular to the second direction F2. The multiple scan lines S1-Sn are insulated from one another, the multiple data lines D1-Dm are insulated from one another, and the multiple scan lines S1-Sn and the multiple data lines D1-Dm are insulated from one another. That is, the multiple scan lines S 1-Sn are spaced apart from one another and insulated from one another, the multiple data lines D1-Dm are spaced apart from one another and insulated from one another, and the multiple scan lines S 1-Sn and the multiple data lines D1-Dm are insulated from one another.

Each of intersections of the multiple scan lines S1-Sn and the multiple data lines D1-Dm is provided with a display drive module 40. Specifically, the display drive module 40 is disposed between any two adjacent scan lines and any two adjacent data lines. Display drive modules 40 in a same column are electrically coupled with a same data line, and display drive modules 40 in a same row are electrically coupled with a same scan line. In implementations of the disclosure, multiple display drive modules 40 are arranged in an array.

In implementations of the disclosure, each of the scan lines is configured to receive a scan signal Scan. Each of the scan lines is electrically coupled with a discharge control module 50, to control the scan signal Scan in the scan line to have a first potential (e.g., to make the scan signal Scan have a high level VGH) when the display device 100 is to be powered off or restarted, so that the display panel 13 can be discharged through the scan signal Scan.

Each of the data lines is configured to receive a data signal Data. Each of the data lines is electrically coupled with a display control module 30. The display control module 30 is configured to selectively transmit a first power-supply voltage Vdd to the display drive module 40 according to the data signal Data.

Figure 6:
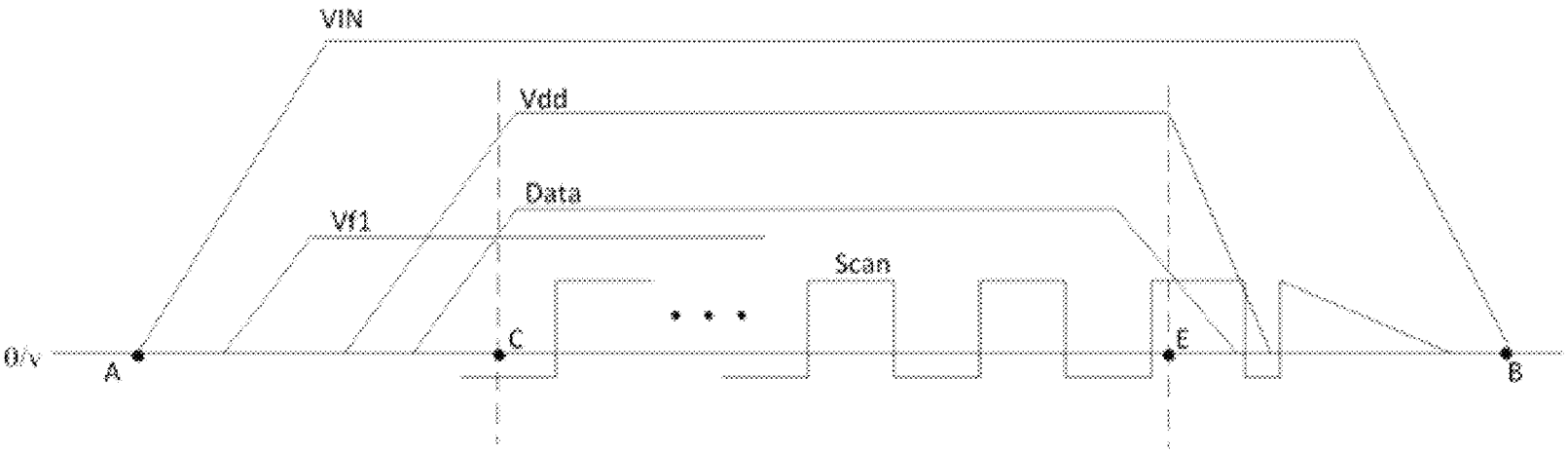
FIG. 6 is a schematic timing diagram of a drive circuit provided in implementations of the disclosure.

Referring to FIG. 6 together, FIG. 6 is a schematic timing diagram of a drive circuit 11 provided in implementations of the disclosure. As illustrated in FIG. 6, a horizontal axis represents time, a vertical-axis value on the horizontal axis represents a voltage of 0 volts, a vertical-axis value above the horizontal axis represents a positive potential, and a vertical-axis value below the horizontal axis represents a negative potential.

The timing of a second power-supply voltage VIN illustrates powered-on time and powered-off time of the display device 100. Specifically, the display device 100 is powered on at a time point A and powered off at a time point B. That is, the time point A is time when the display device 100 is powered on, and the time point B is time when the display device 100 is powered off.

After a time point C, a voltage of the data signal Data becomes higher than a first threshold voltage Vf1, that is, when the voltage of the data signal Data corresponds to a working value, the first power-supply voltage Vdd is transmitted to the drive circuit 11. In this situation, row-based scanning with the scan signal Scan is performed, and the scan signal Scan is periodically switched between a first potential and a second potential.

At a time point E, it can be understood that, the display device 100 is to be powered off or restarted, that is, the first power-supply voltage Vdd gradually decreases, and thus, the display panel 13 is discharged by the discharge control module 50 through the scan signal Scan, until the first power-supply voltage Vdd drops to 0 volts. Since all TFTs of the drive circuit 11 are discharged from the first potential (e.g., a high level VGH of the scan signal Scan), the TFTs are all on, so that the scan signal Scan can be transmitted to a reference ground GND and released quickly. As such, residual charges of the whole display panel can be released more quickly, which can effectively avoid screen flickering of the display device 100.

Based on a same inventive concept, the disclosure further provides a display assembly 10. The display assembly 10 includes the drive circuit 11 and the display panel 13 illustrated in FIG. 3 and FIG. 4. The drive circuit 11 is electrically coupled with the display panel 13, and configured to drive the display panel 13 to display different images.

Based on a same inventive concept, the disclosure further provides a display device 100. The display device 100 includes the above display assembly 10 and a power-supply module 20. The power-supply module 20 is disposed on a non-display surface of the display assembly 10, and configured to provide a power-supply voltage for the display assembly 10 to display images.

It can be understood that, the display device 100 of implementations of the disclosure may be any product or component with a display function, such as a notebook-computer display screen, a Liquid Crystal Display (LCD), an LCD TV, a mobile phone, a tablet computer, etc.

In an implementation, the display device 100 further includes other necessary components and components such as a high-voltage board and a keyboard. Those skilled in the art can make supplements according to a specific type and an actual function of the display device 100, which will not be repeated herein.

It can be understood that, the display device 100 can also be applied to an electronic device with functions such as Personal Digital Assistant (PDA) and/or a music player, where the electronic device may include a mobile phone, a tablet computer, and a wearable electronic device with a wireless communication function (e.g., a smart watch), etc. The above electronic device may also be other electronic devices, such as a laptop computer having a touch-sensitive surface (e.g., a touch panel).

According to the drive circuit 11, the display assembly 10, and the display device 100 of the disclosure, by providing the display control module 30 and the discharge control module 50 in the drive circuit 11, transmission of the first power-supply voltage Vdd in the display drive module 40 can be selectively controlled, that is, timing adjustment of the first power-supply voltage Vdd is achieved, which can effectively ensure accurate transmission of the first power-supply voltage, and avoid screen flickering caused by abnormal light emission of the display drive module 40 when powered on and powered off, thereby improving a display effect of the display panel 13. In addition, by providing the discharge control module 50 in the drive circuit 11, a potential of the first power-supply voltage Vdd in the drive circuit 11 can be detected in real time. When the first power-supply voltage Vdd drops, that is, when the display device 100 is to be powered off or restarted (e.g., when the display device 100 is about to be powered off), discharging of the display device 100 is implemented with the discharge control module 50 through the scan signal Scan, so that all TFTs are discharged from the first potential (e.g., a high level VGH of the scan signal Scan) when the display device 100 is to be powered off. As such, the TFTs are all on, and thus, residual charges of the whole display panel can be released faster, which can avoid screen flickering of the display panel 13 caused by the display drive module 40 being powered on by mistake due to jitter of the first power-supply voltage Vdd or residual charges of the whole display assembly 10 in the drive circuit 11. Therefore, a display effect of the display assembly 10 and the display device 100 can be improved effectively, and a user experience can also be improved.

Possible combinations of technical features in the foregoing implementations are depicted above, and there may also be other possible combinations as long as combinations of these technical features are not contradictory. All these combinations should be considered to fall within the scope of the specification.

In the description of the specification, the terms "an implementation", "some implementations", "exemplary implementation", "example", "specific example/implementations", "some examples", or the like means that particular features, structures, materials, or properties described in conjunction with the implementations or examples may be defined in at least one implementation or example of the disclosure. In the specification, schematic representations of the above terms do not necessarily refer to a same implementation or example. Moreover, the particular features, structures, materials, or properties described may be combined in any suitable manner in any one or more implementations or examples.

It should be understood that, the above merely depicts some implementations of the disclosure in a specific and detailed manner, which should not be construed as a limitation on the scope of the disclosure. It should be pointed out that, any modifications, equivalent substitutions, or improvements made by those skilled in the art without departing from the spirits and principles of the disclosure shall all be encompassed within the protection scope of the disclosure. Therefore, the protection scope of the disclosure should be defined by the appended claims.

What is claimed is:

1. A drive circuit, comprising a display drive module configured to receive a scan signal and a data signal, the drive circuit further comprising at least one display control module and a discharge control module, wherein the display control module is electrically coupled with the display drive module the display control module comprises a first comparator and a first transistor; the first comparator is configured to receive the data signal, compare a voltage of the data signal with a first threshold voltage, and output a level signal according to a first comparison result; the level signal indicates whether the data signal corresponds to a working value; the first transistor is configured to selectively transmit a first power-supply voltage to the display drive module according to the level signal;

the display drive module is configured to transmit, under control of the scan signal and the data signal, the first power-supply voltage to a light-emitting element of the display drive module upon reception of the first power-supply voltage, to drive the light-emitting element to emit lights; and the discharge control module is electrically coupled with the display drive module; the discharge control module comprises a flip-flop, a second comparator, a resistor, and a fourth transistor; the flip-flop is configured to output a trigger signal of a first potential upon detecting that the received first power-supply voltage drops; the second comparator is configured to compare the trigger signal of the first potential with a second threshold voltage, and output a discharge control signal to the fourth transistor according to a second comparison result; the fourth transistor is configured to selectively pull up the scan signal under control of the discharge control signal to discharge the light-emitting element.

2. The drive circuit of claim 1, wherein a non-inverting input end of the first comparator is configured to receive the data signal, an inverting input end of the first comparator is configured to receive the first threshold voltage, an output end of the first comparator is electrically coupled with a control end of the first transistor, and the first comparator is configured to compare the voltage of the data signal with the first threshold voltage, and output the level signal to the control end of the first transistor according to the first comparison result; and a first end of the first transistor is configured to receive the first power-supply voltage, a second end of the first transistor is electrically coupled with the display drive module, and the first transistor is configured to receive the level signal and is switched on or switched off according to the level signal.

3. The drive circuit of claim 2, wherein the first comparator is configured to output the level signal of a first potential to the first transistor when the voltage of the data signal is higher than the first threshold voltage, wherein the first transistor is switched on under control of the level signal of the first potential, to transmit the first power-supply voltage to the display drive module; or the first comparator is configured to output the level signal of a second potential to the first transistor when the voltage of the data signal is lower than or equal to the first threshold voltage, wherein the first transistor is switched off under control of the level signal of the second potential.

4. The drive circuit of claim 2, wherein the display drive module comprises the light-emitting element, a second transistor, a third transistor, and a bypass capacitor, wherein a control end of the second transistor is configured to receive the scan signal, a first end of the second transistor is configured to receive the data signal, a second end of the second transistor is electrically coupled with a control end of the third transistor, and the second transistor is configured to transmit the data signal to the third transistor according to the scan signal;

a first end of the third transistor is electrically coupled with the second end of the first transistor to receive the first power-supply voltage, a second end of the third transistor is electrically coupled with the light-emitting element, and the third transistor is switched on or switched off according to the data signal received; and a first end of the bypass capacitor is electrically coupled with the control end of the third transistor, and a second end of the bypass capacitor is electrically coupled with a reference ground.

5. The drive circuit of claim 4, wherein when the second transistor receives the scan signal of a first potential, the second transistor is switched on to transmit the data signal to the control end of the third transistor, and the third transistor is switched on to transmit the first power-supply voltage to the light-emitting element to drive the light-emitting element to emit lights when the third transistor receives the data signal of a first potential, or the third transistor is switched off when the third transistor receives the data signal of a second potential; or when the second transistor receives the scan signal of a second potential, the second transistor is switched off.

6. The drive circuit of claim 4, wherein the light-emitting element has a positive pole electrically coupled with the second end of the third transistor and a negative pole electrically coupled with the reference ground, wherein the light-emitting element is configured to emit lights once the positive pole of the light-emitting element receives the first power-supply voltage.

7. The drive circuit of claim 4, wherein a clear end of the flip-flop is configured to receive the first power-supply voltage, a preset end of the flip-flop is configured to receive a second power-supply voltage via the resistor, a latch output end of the flip-flop is electrically coupled with a non-inverting input end of the second comparator, and the latch output end of the flip-flop is configured to output the trigger signal of the first potential to the non-inverting input end of the second comparator when the first power-supply voltage drops;

the non-inverting input end of the second comparator is configured to receive the trigger signal, an inverting input end of the second comparator is configured to receive the second threshold voltage, and an output end of the second comparator is configured to output the discharge control signal to a control end of the fourth transistor according to the second comparison result between a voltage of the trigger signal and the second threshold voltage; and the control end of the fourth transistor is electrically coupled with the output end of the second comparator to receive the discharge control signal, a first end of the fourth transistor is configured to transmit the scan signal, a second end of the fourth transistor is configured to receive the scan signal of a first potential, and the fourth transistor is configured to receive, according to the discharge control signal, the scan signal of the first potential to pull up the scan signal.

8. The drive circuit of claim 7, wherein when the voltage of the trigger signal of the first potential is higher than the second threshold voltage, the output end of the second comparator is configured to output the discharge control signal of a first potential to the control end of the fourth transistor, to control the fourth transistor to be switched on to receive the scan signal of the first potential, to pull up the scan signal to have the first potential; or when the voltage of the trigger signal of the first potential is lower than or equal to the second threshold voltage, the output end of the second comparator is configured to output the discharge control signal of a second potential to the control end of the fourth transistor, to control the fourth transistor to be switched off.

9. A display assembly, comprising:

a display panel; and a drive circuit electrically coupled with the display panel and configured to drive the display panel to display different images, wherein the drive circuit comprises a display drive module configured to receive a scan signal and a data signal, at least one display control module, and a discharge control module, wherein the display control module is electrically coupled with the display drive module; the display control module comprises a first comparator and a first transistor; the first comparator is configured to receive the data signal, compare a voltage of the data signal with a first threshold voltage, and output a level signal according to a first comparison result; the level signal indicates whether the data signal corresponds to a working value; the first transistor is configured to selectively transmit a first power-supply voltage to the display drive module according to the level signal;

the display drive module is configured to transmit, under control of the scan signal and the data signal, the first power-supply voltage to a light-emitting element of the display drive module upon reception of the first power-supply voltage, to drive the light-emitting element to emit lights; and the discharge control module is electrically coupled with the display drive module; the discharge control module comprises a flip-flop, a second comparator, a resistor, and a fourth transistor; the flip-flop is configured to output a trigger signal of a first potential upon detecting that the received first power-supply voltage drops; the second comparator is configured to compare the trigger signal of the first potential with a second threshold voltage, and output a discharge control signal to the fourth transistor according to a second comparison result; the fourth transistor is configured to selectively pull up the scan signal under control of the discharge control signal to discharge the light-emitting element.

10. The display assembly of claim 9, wherein a non-inverting input end of the first comparator is configured to receive the data signal, an inverting input end of the first comparator is configured to receive the first threshold voltage, an output end of the first comparator is electrically coupled with a control end of the first transistor, and the first comparator is configured to compare the voltage of the data signal with the first threshold voltage, and output the level signal to the control end of the first transistor according to the first comparison result; and a first end of the first transistor is configured to receive the first power-supply voltage, a second end of the first transistor is electrically coupled with the display drive module, and the first transistor is configured to receive the level signal and is switched on or switched off according to the level signal.

11. The display assembly of claim 10, wherein the first comparator is configured to output the level signal of a first potential to the first transistor when the voltage of the data signal is higher than the first threshold voltage, wherein the first transistor is switched on under control of the level signal of the first potential, to transmit the first power-supply voltage to the display drive module; or the first comparator is configured to output the level signal of a second potential to the first transistor when the voltage of the data signal is lower than or equal to the first threshold voltage, wherein the first transistor is switched off under control of the level signal of the second potential.

12. The display assembly of claim 10, wherein the display drive module comprises the light-emitting element, a second transistor, a third transistor, and a bypass capacitor, wherein a control end of the second transistor is configured to receive the scan signal, a first end of the second transistor is configured to receive the data signal, a second end of the second transistor is electrically coupled with a control end of the third transistor, and the second transistor is configured to transmit the data signal to the third transistor according to the scan signal;

a first end of the third transistor is electrically coupled with the second end of the first transistor to receive the first power-supply voltage, a second end of the third transistor is electrically coupled with the light-emitting element, and the third transistor is switched on or switched off according to the data signal received; and a first end of the bypass capacitor is electrically coupled with the control end of the third transistor, and a second end of the bypass capacitor is electrically coupled with a reference ground.

13. The display assembly of claim 12, wherein when the second transistor receives the scan signal of a first potential, the second transistor is switched on to transmit the data signal to the control end of the third transistor, and the third transistor is switched on to transmit the first power-supply voltage to the light-emitting element to drive the light-emitting element to emit lights when the third transistor receives the data signal of a first potential, or the third transistor is switched off when the third transistor receives the data signal of a second potential; or when the second transistor receives the scan signal of a second potential, the second transistor is switched off.

14. The display assembly of claim 12, wherein the light-emitting element has a positive pole electrically coupled with the second end of the third transistor and a negative pole electrically coupled with the reference ground, wherein the light-emitting element is configured to emit lights once the positive pole of the light-emitting element receives the first power-supply voltage.

15. The display assembly of claim 12, wherein a clear end of the flip-flop is configured to receive the first power-supply voltage, a preset end of the flip-flop is configured to receive a second power-supply voltage via the resistor, a latch output end of the flip-flop is electrically coupled with a non-inverting input end of the second comparator, and the latch output end of the flip-flop is configured to output the trigger signal of the first potential to the non-inverting input end of the second comparator when the first power-supply voltage drops;

the non-inverting input end of the second comparator is configured to receive the trigger signal, an inverting input end of the second comparator is configured to receive the second threshold voltage, and an output end of the second comparator is configured to output the discharge control signal to a control end of the fourth transistor according to the second comparison result between a voltage of the trigger signal and the second threshold voltage; and the control end of the fourth transistor is electrically coupled with the output end of the second comparator to receive the discharge control signal, a first end of the fourth transistor is configured to transmit the scan signal, a second end of the fourth transistor is configured to receive the scan signal of a first potential, and the fourth transistor is configured to receive, according to the discharge control signal, the scan signal of the first potential to pull up the scan signal.

16. The display assembly of claim 15, wherein when the voltage of the trigger signal of the first potential is higher than the second threshold voltage, the output end of the second comparator is configured to output the discharge control signal of a first potential to the control end of the fourth transistor, to control the fourth transistor to be switched on to receive the scan signal of the first potential, to pull up the scan signal to have the first potential; or when the voltage of the trigger signal of the first potential is lower than or equal to the second threshold voltage, the output end of the second comparator is configured to output the discharge control signal of a second potential to the control end of the fourth transistor, to control the fourth transistor to be switched off.

17. A display device, comprising:

a display assembly comprising:

a display panel; and a drive circuit electrically coupled with the display panel and configured to drive the display panel to display different images, wherein the drive circuit comprises a display drive module configured to receive a scan signal and a data signal, at least one display control module, and a discharge control module, wherein the display control module is electrically coupled with the display drive module; the display control module comprises a first comparator and a first transistor; the first comparator is configured to receive the data signal, compare a voltage of the data signal with a first threshold voltage, and output a level signal according to a first comparison result; the level signal indicates whether the data signal corresponds to a working value; the first transistor is configured to selectively transmit a first power-supply voltage to the display drive module according to the level signal;

the display drive module is configured to transmit, under control of the scan signal and the data signal, the first power-supply voltage to a light-emitting element of the display drive module upon reception of the first power-supply voltage, to drive the light-emitting element to emit lights; and the discharge control module is electrically coupled with the display drive module; the discharge control module comprises a flip-flop, a second comparator, a resistor, and a fourth transistor; the flip-flop is configured to output a trigger signal of a first potential upon detecting that the received first power-supply voltage drops; the second comparator is configured to compare the trigger signal of the first potential with a second threshold voltage, and output a discharge control signal to the fourth transistor according to a second comparison result; the fourth transistor is configured to selectively pull up the scan signal under control of the discharge control signal to discharge the light-emitting element; and a power-supply module, disposed on a non-display surface of the display assembly, and configured to provide a power-supply voltage for the display assembly to display images.

18. The display device of claim 17, wherein a non-inverting input end of the first comparator is configured to receive the data signal, an inverting input end of the first comparator is configured to receive the first threshold voltage, an output end of the first comparator is electrically coupled with a control end of the first transistor, and the first comparator is configured to compare the voltage of the data signal with the first threshold voltage, and output the level signal to the control end of the first transistor according to the first comparison result; and a first end of the first transistor is configured to receive the first power-supply voltage, a second end of the first transistor is electrically coupled with the display drive module, and the first transistor is configured to receive the level signal and is switched on or switched off according to the level signal.

19. The display device of claim 18, wherein the first comparator is configured to output the level signal of a first potential to the first transistor when the voltage of the data signal is higher than the first threshold voltage, wherein the first transistor is switched on under control of the level signal of the first potential, to transmit the first power-supply voltage to the display drive module; or the first comparator is configured to output the level signal of a second potential to the first transistor when the voltage of the data signal is lower than or equal to the first threshold voltage, wherein the first transistor is switched off under control of the level signal of the second potential.

20. The display device of claim 18, wherein the display drive module comprises the light-emitting element, a second transistor, a third transistor, and a bypass capacitor, wherein a control end of the second transistor is configured to receive the scan signal, a first end of the second transistor is configured to receive the data signal, a second end of the second transistor is electrically coupled with a control end of the third transistor, and the second transistor is configured to transmit the data signal to the third transistor according to the scan signal;

a first end of the third transistor is electrically coupled with the second end of the first transistor to receive the first power-supply voltage, a second end of the third transistor is electrically coupled with the light-emitting element, and the third transistor is switched on or switched off according to the data signal received; and a first end of the bypass capacitor is electrically coupled with the control end of the third transistor, and a second end of the bypass capacitor is electrically coupled with a reference ground.

* * * * *